US011970910B2

(12) United States Patent
Henke et al.

(10) Patent No.: US 11,970,910 B2
(45) Date of Patent: Apr. 30, 2024

(54) OVER-THE-LINE MODULAR WEIGHT BAR

(71) Applicant: Hunting Titan, Inc., Pampa, TX (US)

(72) Inventors: Albert Joseph Henke, Hallettsville, TX (US); Ryan Bradley, Pampa, TX (US); Dale Langford, Pampa, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 17/906,151

(22) PCT Filed: Mar. 30, 2021

(86) PCT No.: PCT/US2021/024848
§ 371 (c)(1),
(2) Date: Sep. 12, 2022

(87) PCT Pub. No.: WO2021/202502
PCT Pub. Date: Oct. 7, 2021

(65) Prior Publication Data

US 2023/0132716 A1 May 4, 2023

Related U.S. Application Data

(60) Provisional application No. 63/002,012, filed on Mar. 30, 2020.

(51) Int. Cl.
*E21B 17/02* (2006.01)
*E21B 31/20* (2006.01)

(52) U.S. Cl.
CPC ..... *E21B 17/023* (2013.01); *E21B 31/20* (2013.01)

(58) Field of Classification Search
CPC ..... E21B 17/023; E21B 31/20
See application file for complete search history.

(56) References Cited

U.S. PATENT DOCUMENTS

| | | | |
|---|---|---|---|
| 4,580,635 | A | 4/1986 | Radford et al. |
| 4,696,343 | A | 9/1987 | Anderson et al. |
| 6,170,570 | B1 | 1/2001 | Aguesse et al. |
| 2007/0056723 | A1 | 3/2007 | Hall et al. |
| 2009/0242203 | A1 | 10/2009 | Pardey |

OTHER PUBLICATIONS

International Preliminary Report on Patentability and Written Opinion of the International Searching Authority.

*Primary Examiner* — Kristyn A Hall

(57) ABSTRACT

A system and apparatus for applying and removing weight from a tool string over an installed wireline, including a weight section having a longitudinal slot and a removable closure bar.

34 Claims, 10 Drawing Sheets

OVER-THE-LINE MODULAR WEIGHT BAR

RELATED APPLICATIONS

This application is a national phase of PCT/US21/24848, filed Mar. 30, 2021, which claims priority to U.S. Provisional Application No. 63/002,012, filed on Mar. 30, 2020 titled "Over-the-Line Modular Weight Bar."

BACKGROUND OF THE INVENTION

Generally, when drilling and completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well is drilled through one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

During drilling and completing a well, and throughout the complete well's life, tools of various types may be lowered into and retrieved from the well by use of a cable or wireline. These tools are often combined into a tool string that includes multiple tools in series. A wireline can provide both mechanical support for conveying the tools in and out of the well and electronic communication between the surface and any tools in the well. A wireline that does not provide electrical communication or power between the surface and a tool is often referred to as slickline. Electrical power and communication may be provided by a wireline that ties into a cable head at the top of a tool string. The electrical signal may have to travel through several components, subs, and tools before it gets to a particular tool.

The top of a tool string may include a cable head connecting the tool string mechanically and/or electrically to the wireline. The top of a tool string often also includes a fishing neck to facilitate fishing, or retrieval of the tool string, if the wireline is compromised.

A weight bar (also known as a sinker bar or stem) is sometimes added to a tool string to facilitate conveyance of the tool string into the well. For example, the weight bar may overcome wellhead pressure and friction when introducing the tool string into the well bore. An over-the-line (OTL) weight bar is a type of weight bar with no electrical feed through and is inserted above the cable head with the wireline itself running through the inner diameter of the weight assembly. Typical OTL weight bars require that the wireline or cable be disconnected from the cable head and then reconnected to the cable head (reheading) for installation of the weight bar to the tool string. This is a potentially time consuming process that introduces opportunity for errors or malfunctions.

An object of the present invention is to enable the addition of weight to a tool string conveyed by wireline without reheading the wireline or cable.

SUMMARY OF EXAMPLE EMBODIMENTS

An example embodiment may include a weight bar for use on a downhole tool string conveyed by a wireline comprising: a) a longitudinal axis substantially in line with the wireline, b) a weight section comprising: a weight section top end comprising male threads distal from the tool string, a weight section bottom end proximate the tool string comprising female threads in a bottom end bore. a weight section outer surface extending more than degrees about the longitudinal axis between the weight section top end and the weight section bottom end, a cable borehole along the longitudinal axis, a longitudinal slot extending from the weight section bottom end to the weight section top end of the weight section parallel to the longitudinal axis comprising: a first longitudinal slot side wall substantially parallel to the longitudinal axis, and a second longitudinal slot side wall substantially parallel to the longitudinal axis and the first longitudinal side wall, a first longitudinal slot shoulder extending substantially orthogonal from the first longitudinal slot side wall into the longitudinal slot, a second longitudinal slot shoulder extending substantially orthogonal from the second longitudinal slot side wall into the longitudinal slot, a bottom end bore face in the bottom end bore substantially orthogonal to the longitudinal axis, a locking pin slot in the bottom end bore face; c) a slot closure bar, fitting in and substantially filling the longitudinal slot in the weight section, comprising: a slot closure bar top end distal from the tool string, a slot closure bar bottom end opposite the top end, a slot closure bar outer surface extending less than degrees about the longitudinal axis from the slot closure bar top end to the slot closure bar bottom end, a slot closure bar inner surface engaging the first and second longitudinal slot shoulders, a first slot closure bar side wall substantially parallel to the longitudinal axis, a second slot closure bar side wall substantially parallel to the longitudinal axis, a locking pin extending from the first and second slot closure bar side walls substantially orthogonal to the longitudinal axis and engaging the locking pin groove in the weight section bottom bore; and d) wherein the slot closure bar top end has a slot closure bar top end outer surface closer to the longitudinal axis than the male threads on the weight section top end, and slot closure bar bottom end has an inner surface farther from the longitudinal axis than the female threads in weight section bottom end. A further example embodiment may include the locking pin slot extends circumferentially about the longitudinal axis from the first longitudinal slot side wall to the second longitudinal slot side wall.

Another example embodiment may include a weight bar for use in a downhole tool string conveyed by a wireline comprising: a) a longitudinal axis substantially in line with the wireline; b) a weight section comprising: a weight section outer surface, a cable borehole along the longitudinal axis, a weight section top end distal from the tool string, a weight section bottom end proximate the tool string, a longitudinal slot extending from the cable borehole through the weight section outer surface, c) a slot closure bar fitting within the weight section longitudinal slot comprising: a slot closure bar top end, a slot closure bar bottom end, d) a slot closure bar top end retainer restricting movement of the top end of the slot closure bar relative to the weight section in at least one direction; and e) a slot closure bar bottom end retainer restricting movement of the bottom end of the slot closure bar relative to the weight section in at least one direction. In a further example embodiment the weight section further comprises: male threads on the weight section top end. In yet a further example embodiment the weight section further comprises: a bottom end bore in the weight section bottom end. In a further example embodiment the weight section further comprises: female threads in the bottom end bore in the weight section bottom end. In a further example embodiment the weight section outer surface extends more than 180 degrees about the longitudinal axis between the weight section top end and the weight section bottom end. In another example embodiment, the longitudinal slot extends from the weight section bottom end to the weight section top end parallel to the longitudinal axis and comprises: a first longitudinal slot side wall substantially parallel to the longitudinal axis; and a second longitudinal slot side wall substantially parallel to the longitudinal axis and the first longitudinal side wall. In another example embodiment, the slot closure bar top end retainer comprises: a first longitudinal slot shoulder extending substantially orthogonal from the first longitudinal slot side wall into the longitudinal slot. In a further example embodiment, the slot closure bar top end retainer further comprises: a second longitudinal slot shoulder extending substantially orthogonal from the second longitudinal slot side wall into the longitudinal slot. In another example embodiment, the slot closure bar bottom end retainer comprises: a locking pin slot in the bottom end bore face and a locking pin in the slot closure bar. In a further example embodiment the weight section further comprises: a bottom end bore face in the bottom end bore substantially orthogonal to the longitudinal axis. In a further example embodiment the locking pin slot is in the bottom end bore face. In another example embodiment, the slot closure bar fits in and substantially fills the longitudinal slot. In another example embodiment, the slot closure bar comprises: a slot closure bar outer surface extending less than 180 degrees about the longitudinal axis from the slot closure bar top end to the slot closure bar bottom end. In another example embodiment, the slot closure bar comprises: a slot closure bar inner surface engaging the first and second longitudinal slot shoulders; a first slot closure bar side wall substantially parallel to the longitudinal axis; and a second slot closure bar side wall substantially parallel to the longitudinal axis. In a further example embodiment the slot closure bar retainer comprises: a locking pin extending from the first and second slot closure bar side walls substantially orthogonal to the longitudinal axis and engaging a locking pin groove in a weight section bottom bore. In another example embodiment, the slot closure bar top end has a slot closure bar top end outer surface closer to the longitudinal axis than the male threads on the weight section top end, and slot closure bar bottom end has an inner surface farther from the longitudinal axis than the female threads in weight section bottom end.

Another example embodiment may include an apparatus for use downhole comprising: a tool string; a cable head connecting the tool string to a wireline; a fishing neck top sub attached to a top end of the tool string at a bottom of the fishing neck top sub; a cable head bottom adapter attached to the fishing neck top sub opposite the tool string; a weight bar comprising: a) a longitudinal axis substantially in line with the wireline; b) a weight section comprising: a weight section outer surface, a cable borehole along the longitudinal axis, a weight section top end distal from the tool string, a weight section bottom end proximate the tool string, a longitudinal slot extending from the cable borehole through the weight section outer surface, c) a slot closure bar fitting within the weight section longitudinal slot comprising: a slot closure bar top end, a slot closure bar bottom end, d) a slot closure bar top end retainer restricting movement of the top end of the slot closure bar relative to the weight section in at least one direction; and e) a slot closure bar bottom end retainer restricting movement of the bottom end of the slot closure bar relative to the weight section in at least one direction. In a further example embodiment the weight section further comprises: male threads on the weight section top end. In yet a further example embodiment the weight section further comprises: a bottom end bore in the weight section bottom end. In yet a further example embodiment the weight section further comprises: female threads in the bottom end bore in the weight section bottom end. In another example embodiment, the weight section outer surface extends more than 180 degrees about the longitudinal axis between the weight section top end and the weight section bottom end. In a further example embodiment the longitudinal slot extends from the weight section bottom end to the weight section top end parallel to the longitudinal axis and comprises: a first longitudinal slot side wall substantially parallel to the longitudinal axis; and a second longitudinal slot side wall substantially parallel to the longitudinal axis and the first longitudinal side wall. In another further example embodiment the slot closure bar top end retainer comprises: a first longitudinal slot shoulder extending substantially orthogonal from the first longitudinal slot side wall into the longitudinal slot. In a yet further example embodiment the slot closure bar top end retainer further comprises: a second longitudinal slot shoulder extending substantially orthogonal from the second longitudinal slot side wall into the longitudinal slot. In another further example embodiment the slot closure bar bottom end retainer comprises: a locking pin slot in the bottom end bore face and a locking pin in the slot closure bar. In a yet further example embodiment the weight section further comprises: a bottom end bore face in the bottom end bore substantially orthogonal to the longitudinal axis. In a yet further example embodiment the locking pin slot is in the bottom end bore face. In another further example embodiment the slot closure bar fits in and substantially fills the longitudinal slot. In another further example embodiment, the slot closure bar comprises: a slot closure bar outer surface extending less than degrees about the longitudinal axis from the slot closure bar top end to the slot closure bar bottom end. In a yet further example embodiment the slot closure bar comprises: a slot closure bar inner surface engaging the first and second longitudinal slot shoulders; a first slot closure bar side wall substantially parallel to the longitudinal axis; and a second slot closure bar side wall substantially parallel to the longitudinal axis. In a yet further example embodiment, the slot closure bar retainer comprises: a locking pin extending from the first and second slot closure bar side walls substantially orthogonal to the longitudinal axis and engaging a locking pin groove in a weight section bottom bore. In another further example embodiment, the slot closure bar top end has a slot closure bar top end outer surface closer to the longitudinal axis than the male threads on the weight section top end, and slot closure bar bottom end has an inner surface farther from the longitudinal axis than the female threads in weight section bottom end.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Downhole tool string components are typically assembled along a common longitudinal axis because they must typically transit a narrow cylindrical borehole. In the examples of FIGS. 1-8 this longitudinal axis is represented by the wireline 600.

Figure 1:
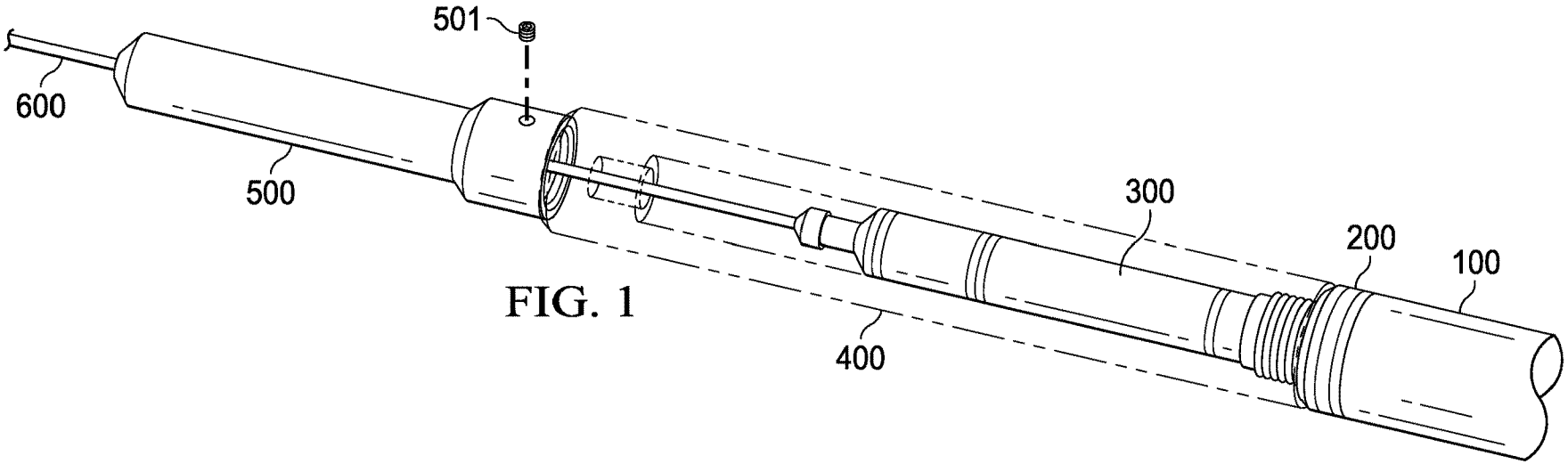
FIG. 1 shows a perspective view of components at the top end of a tool string without a weight bar.

An example set of components at the top end of a tool string is shown in FIG. 1 showing a wireline 600 that extends from the surface through a fishing neck 500 and a cable head bottom adapter 400 (shows in dashed lines to allow visibility of other components) to a cable head 300. In this example, the cable head 300 and bottom adapter 400 are attached to the tool string 100 though fishing neck top sub 200. Typically these parts are threadably attached, but may also be bolted together, attached with set screws, attached with any other attachment mechanism, or any combination of methods. In the example of FIG. 1, the fishing neck 500 threads onto the bottom adapter 400 and is also secured with a cup point set screw 501.

Figure 2:
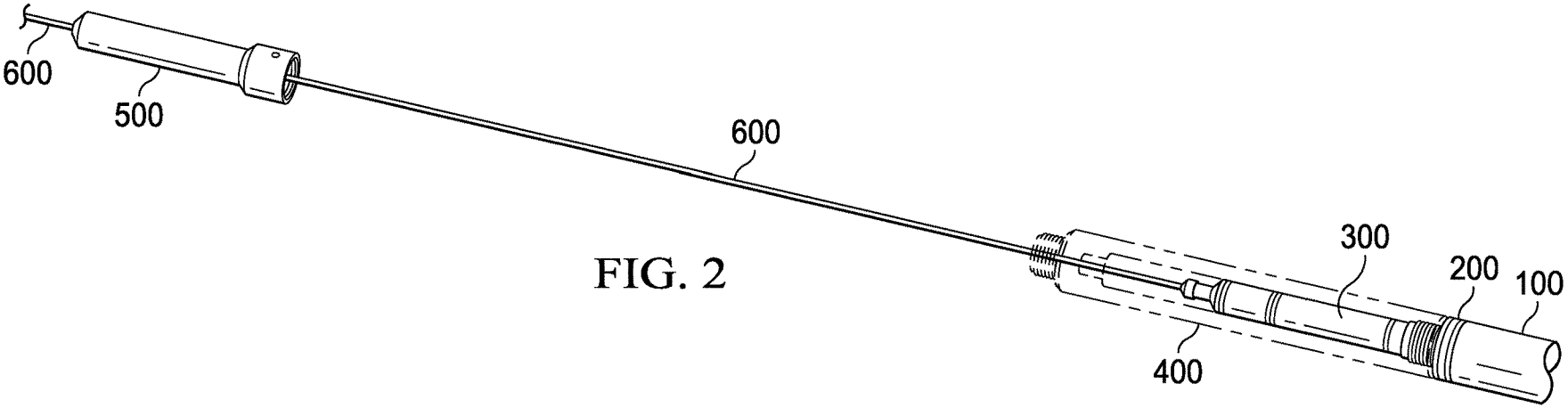
FIG. 2 shows a perspective view of components at the top end of a tool string without a weight bar with the fishing neck disconnected.
Figure 3B:
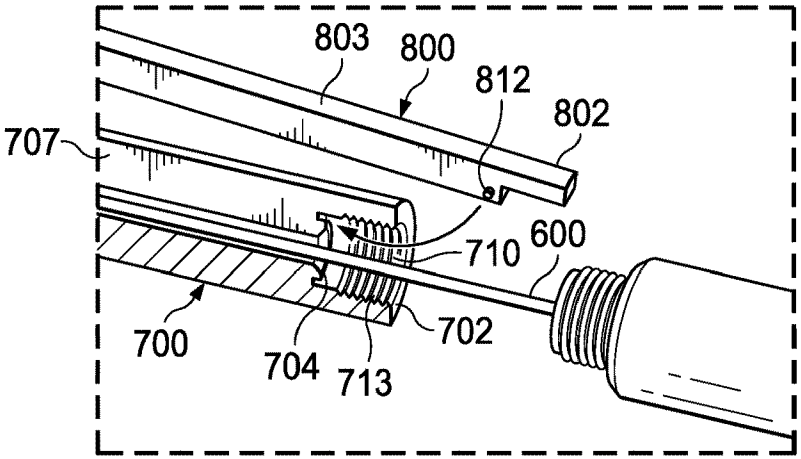
FIG. 3B shows detail view of a perspective view of components at the top end of a tool string during attachment of a modular weight bar.
Figure 3A:
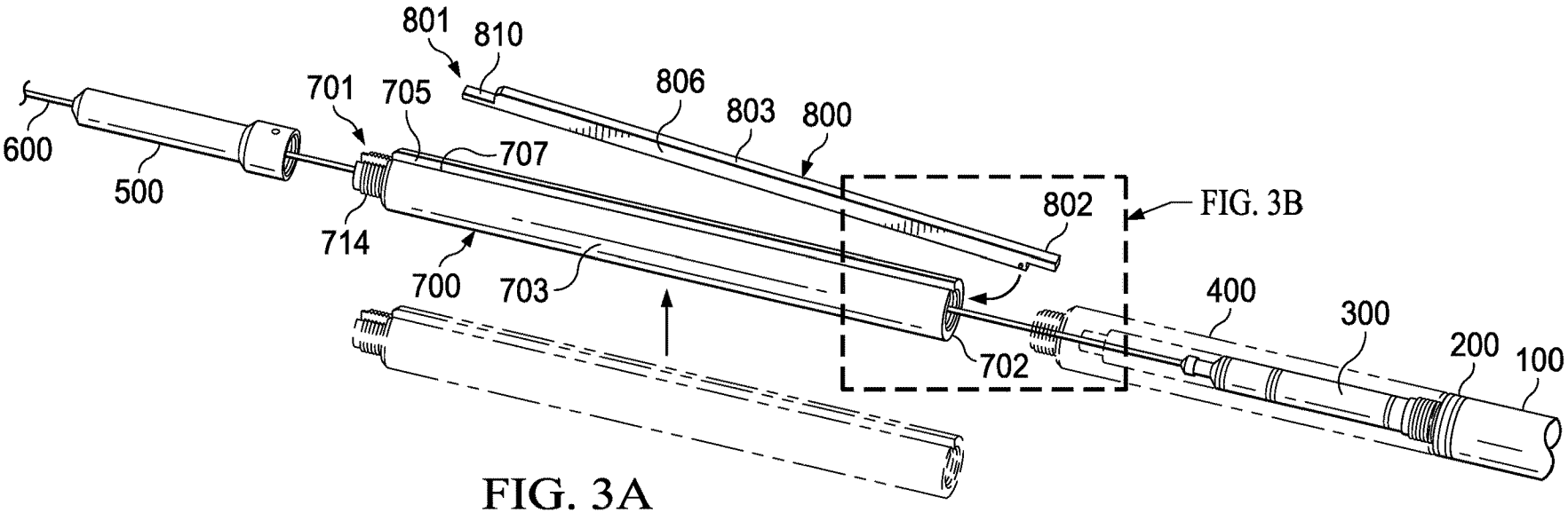
FIG. 3A shows a perspective view of components at the top end of a tool string during attachment of a modular weight bar.
Figure 4:
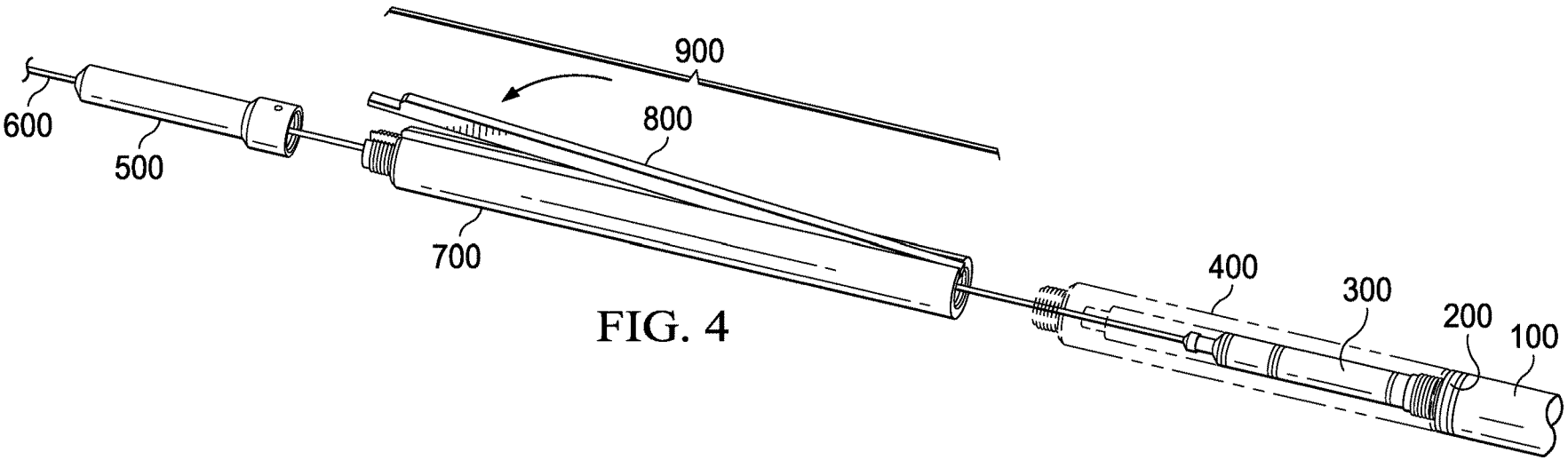
FIG. 4 shows a perspective view of components at the top end of a tool string during attachment of a modular weight bar.
Figure 5:
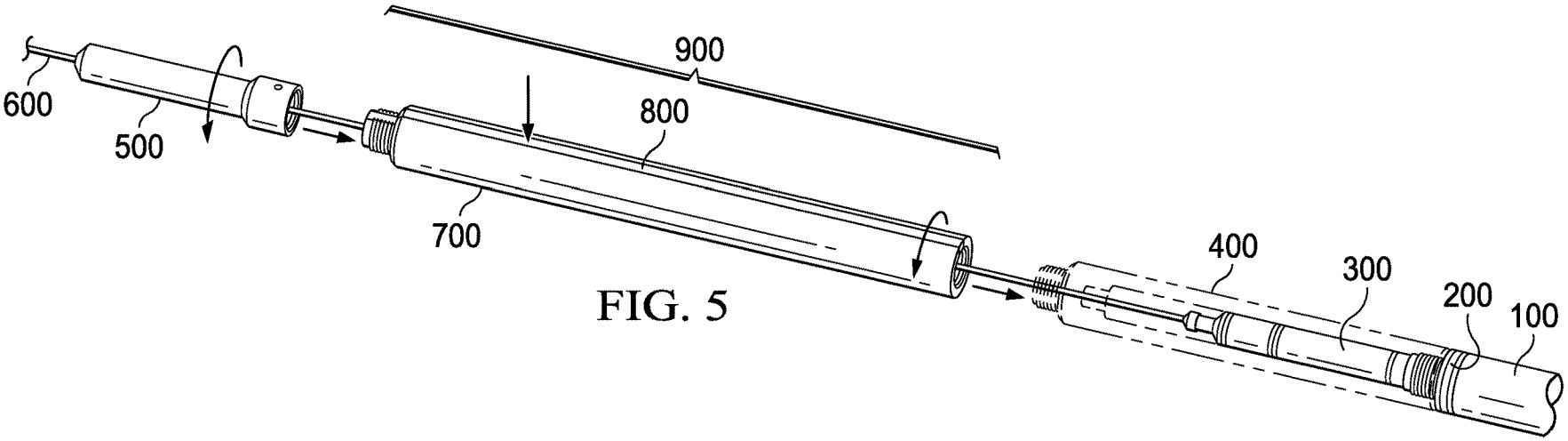
FIG. 5 shows a perspective view of components at the top end of a tool string during attachment of a modular weight bar.

FIG. 2 shows the example set of components at the top end of a tool string of FIG. 1 with the fishing neck 500 detached from the bottom adapter 400 for attachment of a modular weight bar 900 to the tool string 100 over the wireline 600. This is an example of the first step in adding a modular weight bar to a tool string without reheading the cable or wireline 600 into a cable head 300.

An example insertion of a modular weight bar is shown in FIGS. 3A through 15. In this example, a weight section 700 is placed over the wireline 600 between the fishing neck 500 and the bottom adapter 400 as indicated by the arrow. This example weight section 700 has a longitudinal slot 705 leading from the weight section outer surface 703 to a cable borehole 704 from the weight section top end 701 to the weight section bottom end 702. The cable borehole is sized to accommodate the wireline 600 along the longitudinal axis. The longitudinal slot 705 allows the weight section 700 to be placed over the wireline 600 while the wireline is still attached to other components at each end. In this example, weight section top end 701 has male threads 714 for engaging complimentary threads in fishing neck 500, though these components could be attached through other mechanisms as mentioned above. In this example, weight section bottom end 702 has female threads 713 for engaging complimentary threads in bottom adapter 400, though these components could be attached through other mechanisms as mentioned above. In this example, the weight section bottom end 702 is proximate the tool string 100 and the weight section top end 701 is distal from the tool string 100; however, this direction could be reversed by appropriate modification of the attachment mechanisms of either the weight bar 900 and/or adjacent components. In this example, weight section bottom end 702 has a bottom end bore 710 including female threads 713. In this example, there is a bottom end bore face 711 in the weight section bottom end bore 710 substantially orthogonal to the longitudinal axis and the locking pin slot 712 is in the bottom end bore face 711.

The example of FIGS. 3A through 15 also show a slot closure bar 800 for insertion into the longitudinal slot 705. In this example, the slot closure bar 800 has a slot closure bar bottom end 802 proximate the tool string 100 and a slot closure bar top end 801 distal from the tool string 100. This slot closure bar has a locking pin 812 for restricting movement the slot closure bar bottom end 802 relative to the weight section 700. In this example, the locking pin 812 engages a locking pin slot 712 in the weight section bottom bore 710. This allows the slot closure bar 800 to be attached to the weight section by hooking the locking pin in the weight section bottom bore 710 and/or locking pin slot 712 and rotating slot closure bar top end 801 toward weight section 700. Slot closure bar top end 801 is then be captured and held against weight section 700 by threading fishing neck 500 onto weight section top end 701. Weight bar 900 is then be attached to bottom adapter 400 by threading weight section bottom end 702 onto bottom adapter 400 and secured with cup point set screws 401 and 501.

Figure 6A:
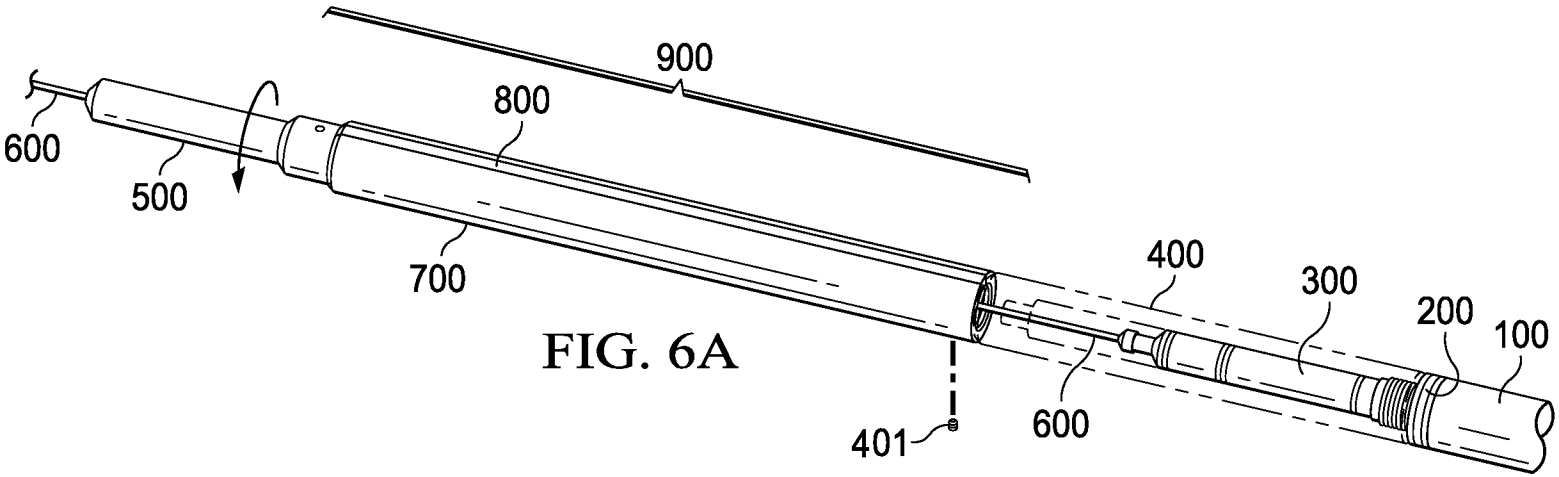
FIG. 6A shows a perspective view of components at the top end of a tool string during attachment of a modular weight bar.
Figure 6B:
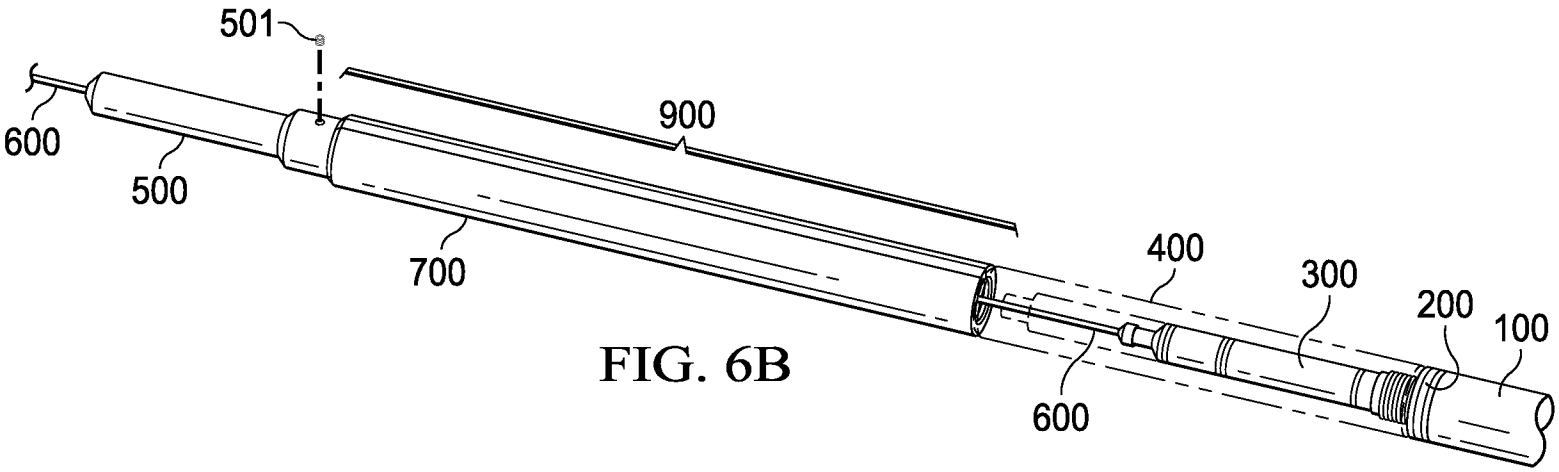
FIG. 6B shows a perspective view of components at the top end of a tool string during attachment of a modular weight bar.
Figure 7:
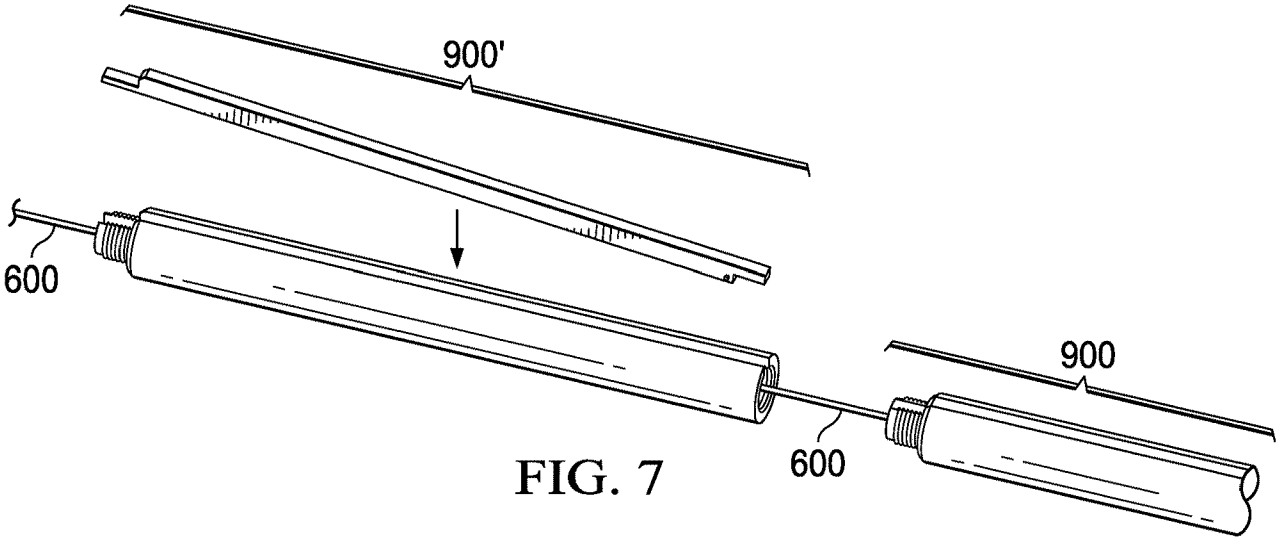
FIG. 7 shows a perspective view of components at the top end of a tool string during attachment of a second modular weight bar.
Figure 8:
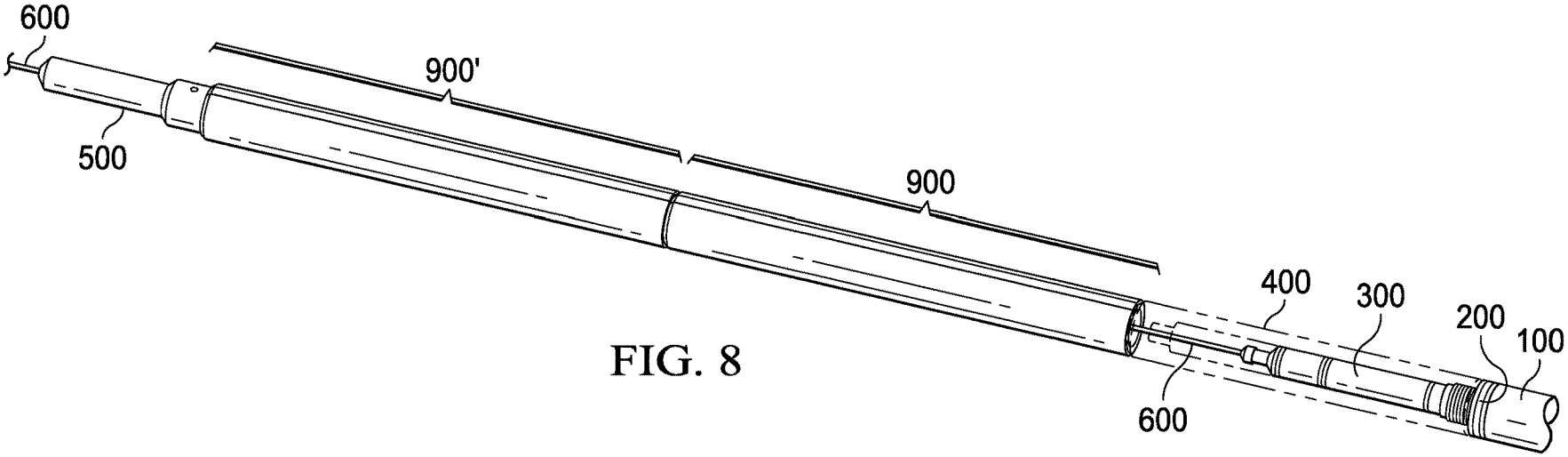
FIG. 8 shows a perspective view of components at the top end of a tool string during attachment of a second modular weight bar.

FIGS. 6B and 8 show the insertion of a second weight bar 900' between weight bar 900 and fishing neck 500 through the same methods and mechanisms described above with respect to the insertion and attachment of weight bar 900 where weight bar 900' is attached to weight bar 900 rather than bottom adapter 400.

Figure 9:
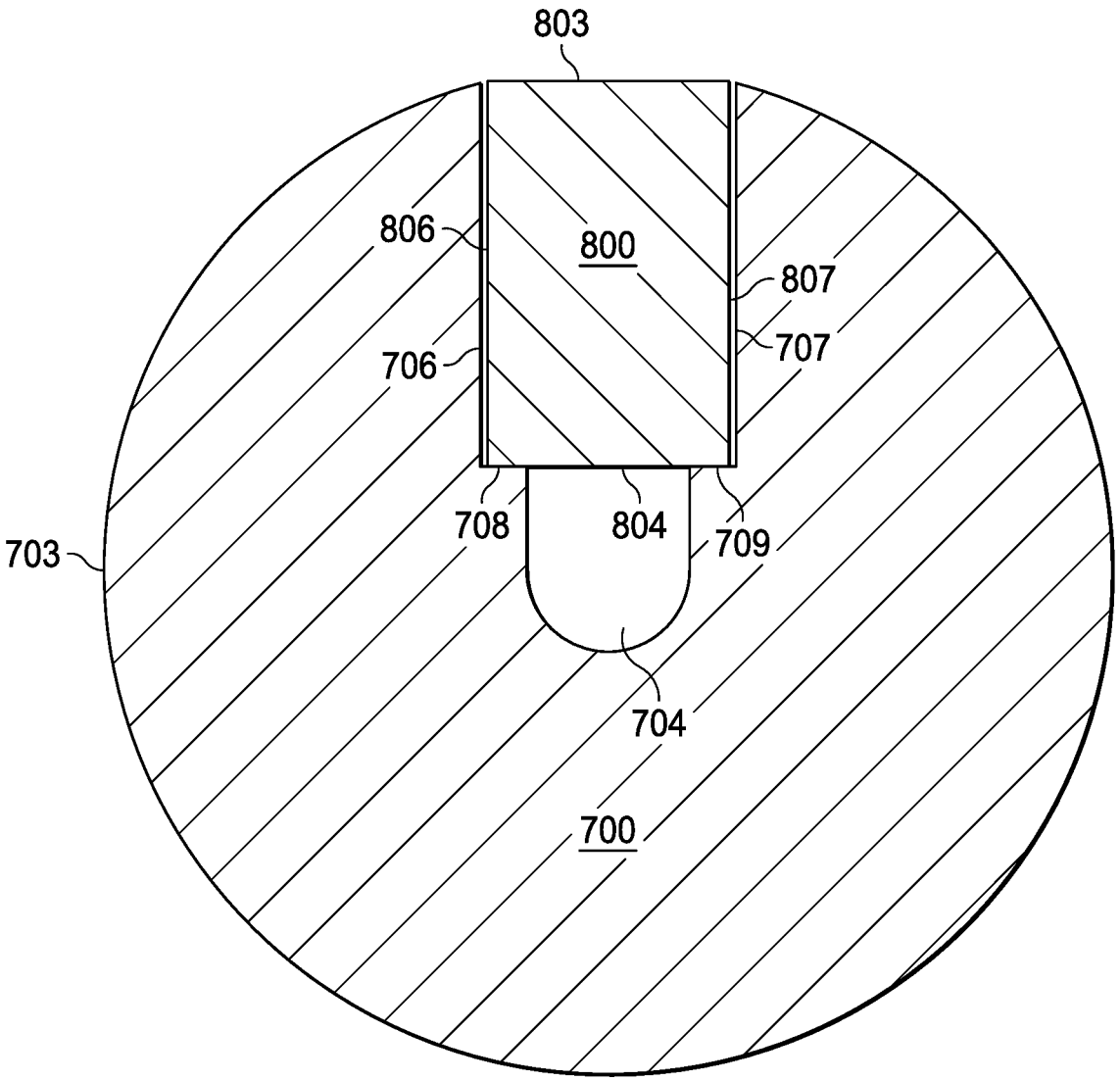
FIG. 9 shows a cross section view through the middle of a modular weight bar.

FIG. 9 is a cross section view through the middle of an example weight bar 900. The example of FIG. 9 shows the weight section 700 with outer surface 703, cable borehole 704, a first longitudinal slot side wall 706, a second longitudinal slot side wall 707, and first and second longitudinal slot shoulders 708 and 709 respectively. In this example, the first and second longitudinal slot side walls 706 and 707 are substantially parallel to the longitudinal axis of the weight section 700. In this example, the first and second longitudinal slot shoulders 708 and 709 are substantially parallel to the longitudinal axis and orthogonal to and extending from the longitudinal slot side walls 706 and 707 into the longitudinal slot 705. As shown in the example of FIG. 9 the longitudinal slot shoulders 708 and 709 restrict slot closure bar 800 from intruding into cable borehole 704. In this example, the weight section outer surface 703 extends more than 180 degrees about the longitudinal axis centered in cable borehole 704.

In the example of FIG. 9, the slot closure bar 800 has an outer surface 803 that extends less than 180 degrees about the longitudinal axis of the weight bar 900 and weight section 700. The slot closure bar of this example also has a first and second side wall 806 and 807, respectively and an inner surface 804. FIG. 9 shows the slot closure bar fitting within and substantially filling longitudinal slot 705.

Figure 10:
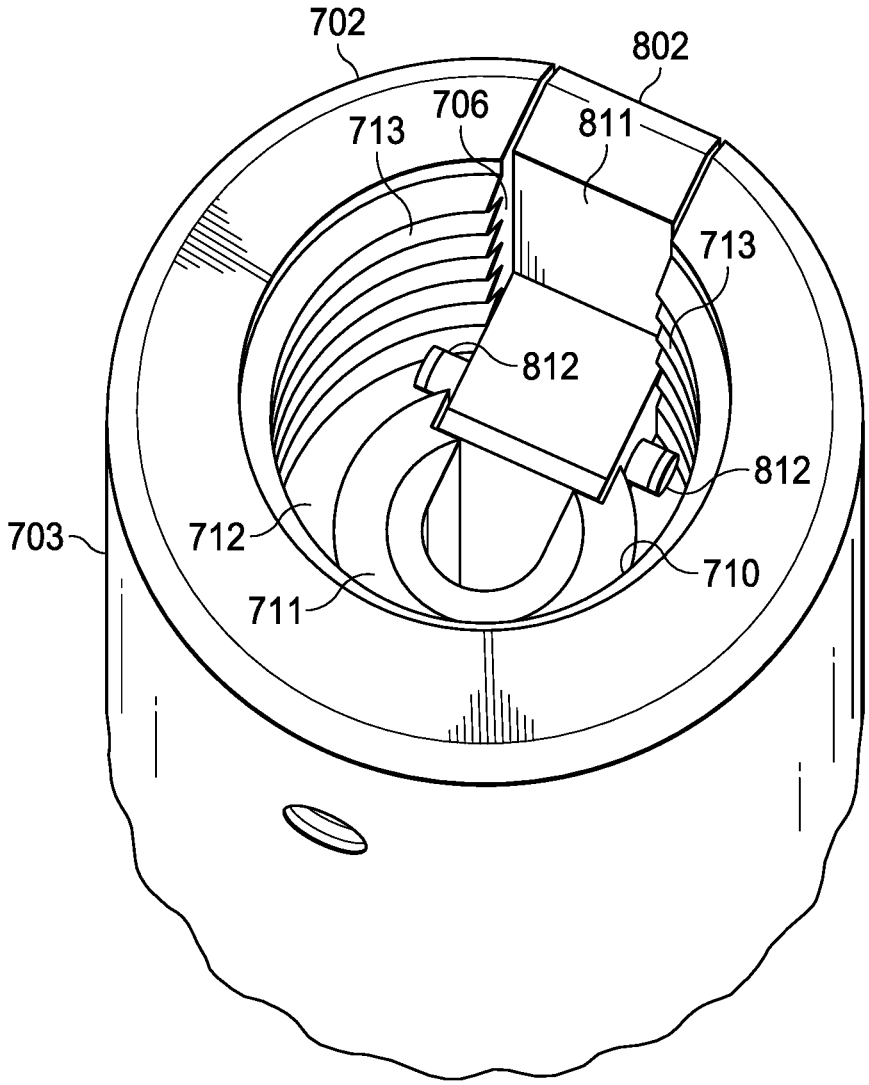
FIG. 10 shows a perspective view of a bottom end of a modular weight bar.

FIG. 10 shows an example bottom end of weight bar 900, including weight section bottom end 702 and slot closure bar bottom end 802. FIG. 10 shows bottom bore 710 in weight section bottom end 702 and bottom bore face 711 and female threads 713 in bottom bore 710. Bottom bore face 711 is substantially orthogonal to the longitudinal axis. This example also shows an example locking pin slot 712 as a slot in bottom bore face 711 circumferentially about the longitudinal axis from first longitudinal slot wall 706 to second longitudinal slot wall 707. Alternatively, locking pin slot 712 could be a straight slot orthogonal to the longitudinal axis or a slot in an outer wall of bottom bore 710 adjacent to or through female threads 713. Also seen in the example of FIG. 10 is slot closure bar bottom end 802 with an inner surface 811 that is farther from the longitudinal axis than female threads 713 so as to avoid interference with complementary threads. This example also shows locking pin 812 in locking pin slot 712, restricting the movement of slot closure bar 800 relative to the weight section 700 both radially relative to the longitudinal axis and toward the weight section top end 701. Locking pin 812 can extend from either or both of slot closure bar side walls 706 and 707 or be integral with them.

Figure 11:
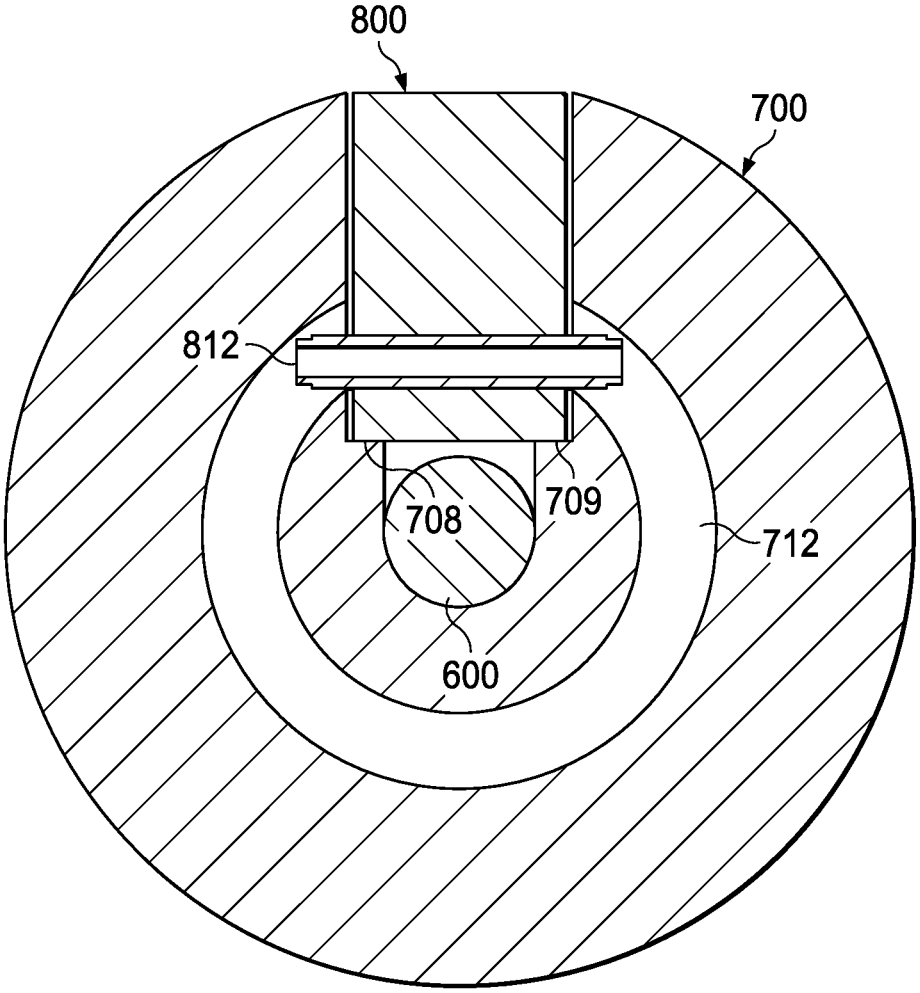
FIG. 11 shows a cross section view through the bottom end of a modular weight bar.

FIG. 11 is a cross section of an example weight bar 900 through the locking pin 812 orthogonal to the longitudinal axis through the center of wireline 600. This example shows relative positions of wireline 600, weight section 700, slot closure bar 800, locking pin 812, locking pin slot 712, and first and second longitudinal slot shoulders 708 and 709.

Figure 12:
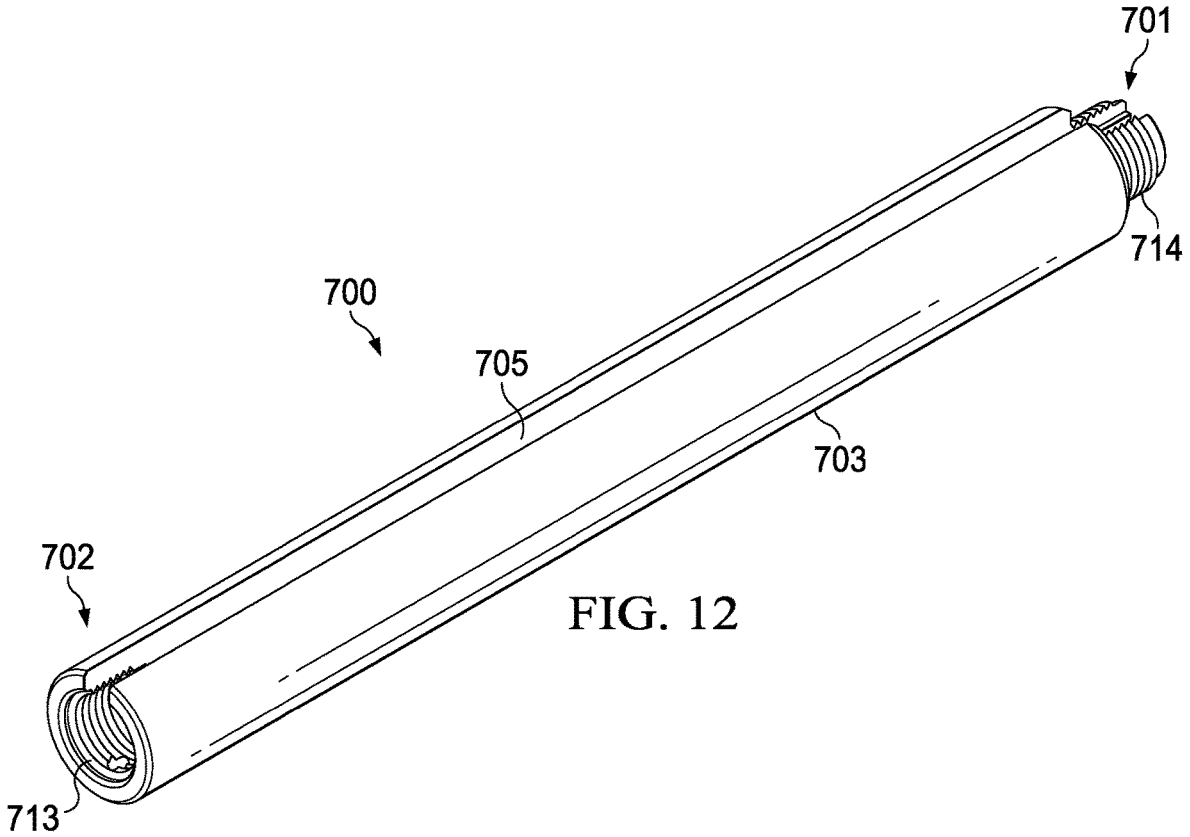
FIG. 12 shows a perspective view of weight section of a modular weight bar.

FIG. 12 is a perspective view of an example weight section 700 from the bottom end showing the relative positions and arrangement of weight section top end 701, weight section bottom end 702, weight section outer surface 703, longitudinal slot 705, female threads 713, and male threads 714.

Figure 13:
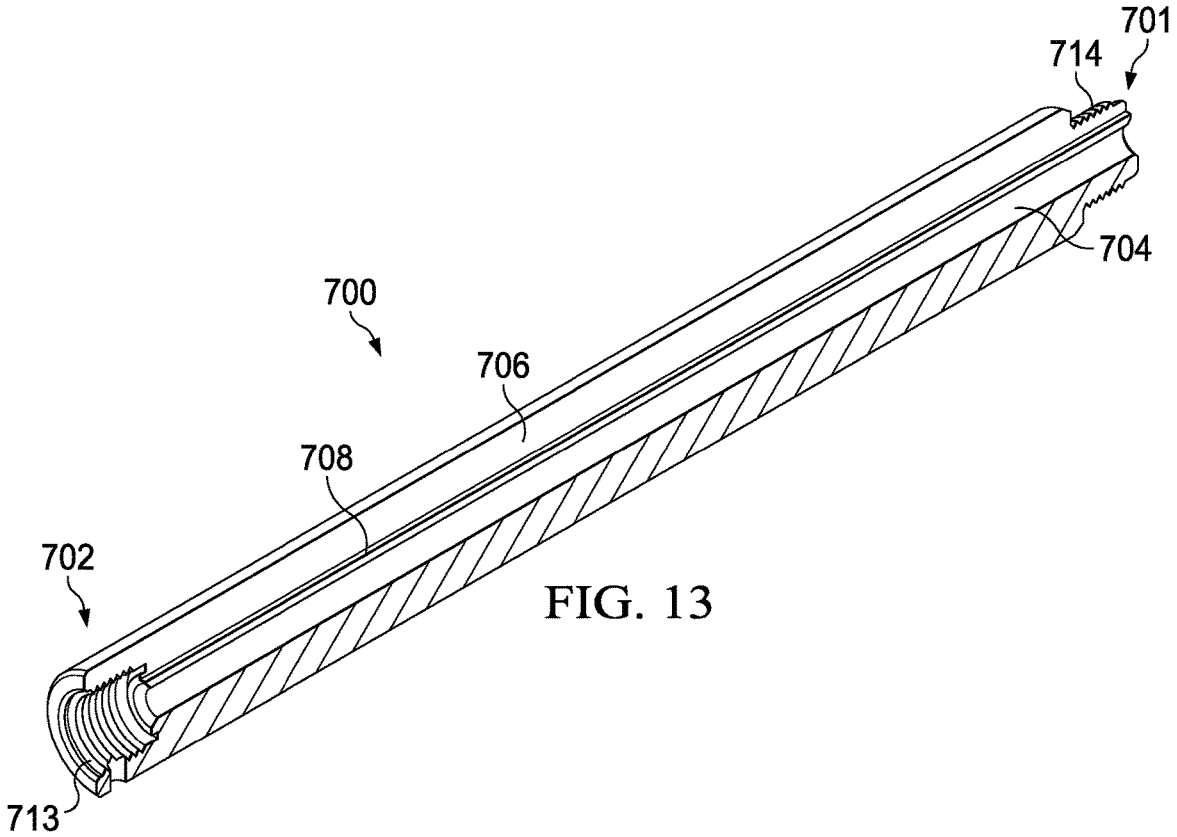
FIG. 13 shows a perspective cross section view of weight section of a modular weight bar.

FIG. 13 is a perspective cross-section (parallel to the first longitudinal slot wall 706 and parallel to and through the longitudinal axis) view of an example weight section 700 from the bottom end showing the relative positions and arrangement of weight section top end 701, weight section bottom end 702, weight section outer surface 703, first longitudinal slot wall 706, first longitudinal slot shoulder 708, female threads 713, and male threads 714.

Figure 14:
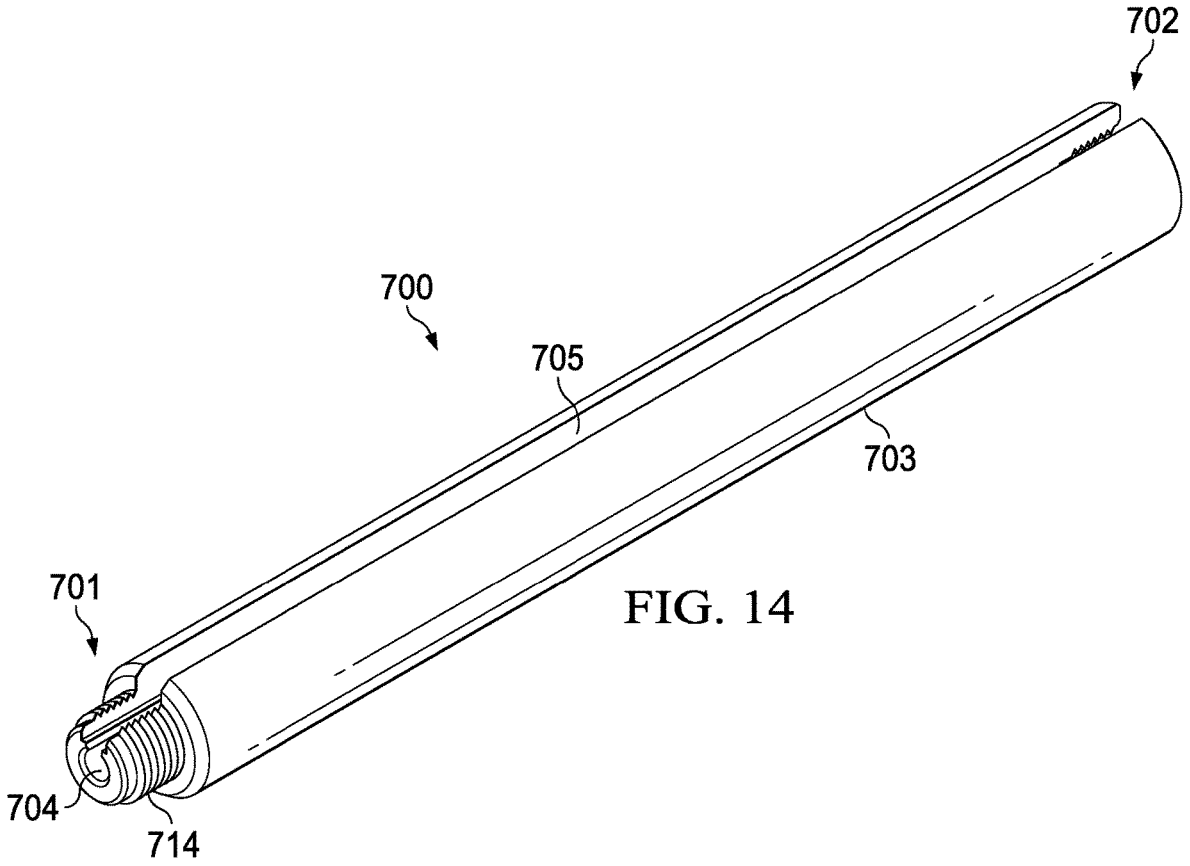
FIG. 14 shows a perspective view of weight section of a modular weight bar.

FIG. 14 is a perspective view of an example weight section 700 from the top end showing the relative positions and arrangement of weight section top end 701, weight section bottom end 702, weight section outer surface 703, longitudinal slot 705, female threads 713, male threads 714, and second longitudinal slot shoulder 709.

Figure 15:
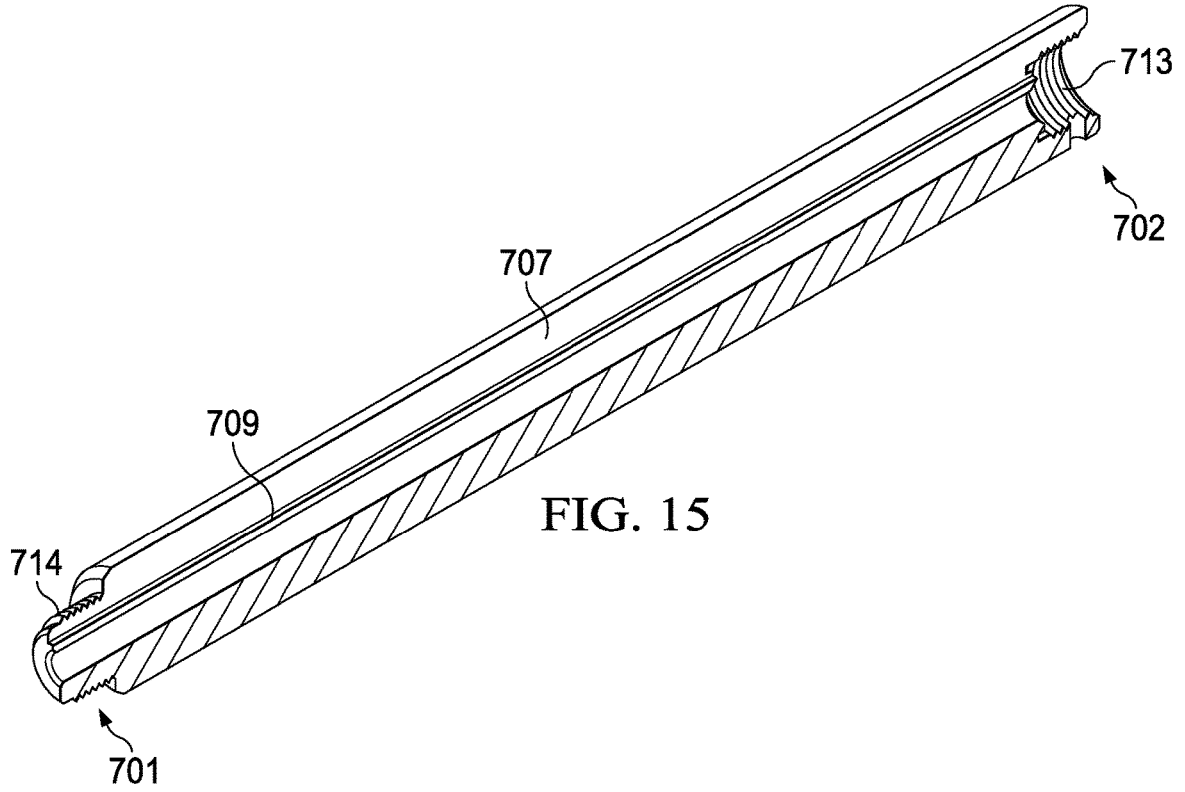
FIG. 15 shows a perspective cross section view of weight section of a modular weight bar.

FIG. 15 is a perspective cross-section (parallel to the second longitudinal slot wall 706 and parallel to and through the longitudinal axis) view of an example weight section 700 from the top end showing the relative positions and arrangement of weight section top end 701, weight section bottom end 702, weight section outer surface 703, second longitudinal slot wall 707, second longitudinal slot shoulder 709, female threads 713, and male threads 714.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A weight bar for use on a downhole tool string conveyed by a wireline comprising:

a) a longitudinal axis substantially in line with the wireline, b) a weight section comprising:

a weight section top end comprising male threads distal from the tool string, a weight section bottom end proximate the tool string comprising female threads in a bottom end bore, a weight section outer surface extending more than 180 degrees about the longitudinal axis between the weight section top end and the weight section bottom end, a cable borehole along the longitudinal axis, a longitudinal slot extending from the weight section bottom end to the weight section top end of the weight section parallel to the longitudinal axis comprising:

a first longitudinal slot side wall substantially parallel to the longitudinal axis, and a second longitudinal slot side wall substantially parallel to the longitudinal axis and the first longitudinal side wall, a first longitudinal slot shoulder extending substantially orthogonal from the first longitudinal slot side wall into the longitudinal slot, a second longitudinal slot shoulder extending substantially orthogonal from the second longitudinal slot side wall into the longitudinal slot, a bottom end bore face in the bottom end bore substantially orthogonal to the longitudinal axis, a locking pin slot in the bottom end bore face;

c) a slot closure bar, fitting in and substantially filling the longitudinal slot in the weight section, comprising:

a slot closure bar top end distal from the tool string, a slot closure bar bottom end opposite the top end, a slot closure bar outer surface extending less than 180 degrees about the longitudinal axis from the slot closure bar top end to the slot closure bar bottom end, a slot closure bar inner surface engaging the first and second longitudinal slot shoulders, a first slot closure bar side wall substantially parallel to the longitudinal axis, a second slot closure bar side wall substantially parallel to the longitudinal axis, a locking pin extending from the first and second slot closure bar side walls substantially orthogonal to the longitudinal axis and engaging the locking pin groove in the weight section bottom bore; and d) wherein the slot closure bar top end has a slot closure bar top end outer surface closer to the longitudinal axis than the male threads on the weight section top end, and slot closure bar bottom end has an inner surface farther from the longitudinal axis than the female threads in weight section bottom end.

2. The weight bar of claim 1 wherein the locking pin slot extends circumferentially about the longitudinal axis from the first longitudinal slot side wall to the second longitudinal slot side wall.

3. A weight bar for use in a downhole tool string conveyed by a wireline comprising:

a) a longitudinal axis substantially in line with the wireline;

b) a weight section comprising:

a weight section outer surface, a cable borehole along the longitudinal axis, a weight section top end distal from the tool string, a weight section bottom end proximate the tool string, a longitudinal slot extending from the cable borehole through the weight section outer surface, c) a slot closure bar fitting within the weight section longitudinal slot comprising:

a slot closure bar top end, a slot closure bar bottom end, d) a slot closure bar top end retainer restricting movement of the top end of the slot closure bar relative to the weight section in at least one direction; and e) a slot closure bar bottom end retainer restricting movement of the bottom end of the slot closure bar relative to the weight section in at least one direction.

4. The weight bar of claim 3, wherein the weight section further comprises: male threads on the weight section top end.

5. The weight bar of claim 4, wherein the weight section further comprises: a bottom end bore in the weight section bottom end.

6. The weight bar of claim 5, wherein the weight section further comprises: female threads in the bottom end bore in the weight section bottom end.

7. The weight bar of claim 6 wherein the slot closure bar top end has a slot closure bar top end outer surface closer to the longitudinal axis than the male threads on the weight section top end, and slot closure bar bottom end has an inner surface farther from the longitudinal axis than the female threads in weight section bottom end.

8. The weight bar of claim 3, wherein the weight section outer surface extends more than 180 degrees about the longitudinal axis between the weight section top end and the weight section bottom end.

9. The weight bar of claim 3, wherein the longitudinal slot extends from the weight section bottom end to the weight section top end parallel to the longitudinal axis and comprises:

a first longitudinal slot side wall substantially parallel to the longitudinal axis; and a second longitudinal slot side wall substantially parallel to the longitudinal axis and the first longitudinal side wall.

10. The weight bar of claim 3, wherein the slot closure bar top end retainer comprises:

a first longitudinal slot shoulder extending substantially orthogonal from the first longitudinal slot side wall into the longitudinal slot.

11. The weight bar of claim 10, wherein the slot closure bar top end retainer further comprises:

a second longitudinal slot shoulder extending substantially orthogonal from the second longitudinal slot side wall into the longitudinal slot.

12. The weight bar of claim 3, wherein the slot closure bar bottom end retainer comprises:

a locking pin slot in the bottom end bore face and a locking pin in the slot closure bar.

13. The weight bar of claim 12, wherein the weight section further comprises:

a bottom end bore face in the bottom end bore substantially orthogonal to the longitudinal axis.

14. The weight bar of claim 13, wherein the locking pin slot is in the bottom end bore face.

15. The weight bar of claim 3 wherein the slot closure bar fits in and substantially fills the longitudinal slot.

16. The weight bar of claim 3 wherein the slot closure bar comprises: a slot closure bar outer surface extending less than 180 degrees about the longitudinal axis from the slot closure bar top end to the slot closure bar bottom end.

17. The weight bar of claim 3 wherein the slot closure bar comprises:

a slot closure bar inner surface engaging the first and second longitudinal slot shoulders;

a first slot closure bar side wall substantially parallel to the longitudinal axis; and a second slot closure bar side wall substantially parallel to the longitudinal axis.

18. The weight bar of claim 17 wherein the slot closure bar retainer comprises: a locking pin extending from the first and second slot closure bar side walls substantially orthogonal to the longitudinal axis and engaging a locking pin groove in a weight section bottom bore.

19. An apparatus for use downhole comprising:

a tool string;

a cable head connecting the tool string to a wireline;

a fishing neck top sub attached to a top end of the tool string at a bottom of the fishing neck top sub;

a cable head bottom adapter attached to the fishing neck top sub opposite the tool string;

a weight bar comprising:

a) a longitudinal axis substantially in line with the wireline;

b) a weight section comprising:

a weight section outer surface, a cable borehole along the longitudinal axis, a weight section top end distal from the tool string, a weight section bottom end proximate the tool string, a longitudinal slot extending from the cable borehole through the weight section outer surface, c) a slot closure bar fitting within the weight section longitudinal slot comprising:

a slot closure bar top end, a slot closure bar bottom end, d) a slot closure bar top end retainer restricting movement of the top end of the slot closure bar relative to the weight section in at least one direction; and e) a slot closure bar bottom end retainer restricting movement of the bottom end of the slot closure bar relative to the weight section in at least one direction.

20. The weight bar of claim 19, wherein the weight section further comprises: male threads on the weight section top end.

21. The weight bar of claim 20, wherein the weight section further comprises: a bottom end bore in the weight section bottom end.

22. The weight bar of claim 21, wherein the weight section further comprises: female threads in the bottom end bore in the weight section bottom end.

23. The weight bar of claim 22 wherein the slot closure bar top end has a slot closure bar top end outer surface closer to the longitudinal axis than the male threads on the weight section top end, and slot closure bar bottom end has an inner surface farther from the longitudinal axis than the female threads in weight section bottom end.

24. The weight bar of claim 19, wherein the weight section outer surface extends more than 180 degrees about the longitudinal axis between the weight section top end and the weight section bottom end.

25. The weight bar of claim 19, wherein the longitudinal slot extends from the weight section bottom end to the weight section top end parallel to the longitudinal axis and comprises:

a first longitudinal slot side wall substantially parallel to the longitudinal axis; and a second longitudinal slot side wall substantially parallel to the longitudinal axis and the first longitudinal side wall.

26. The weight bar of claim 19, wherein the slot closure bar top end retainer comprises:

a first longitudinal slot shoulder extending substantially orthogonal from the first longitudinal slot side wall into the longitudinal slot.

27. The weight bar of claim 26, wherein the slot closure bar top end retainer further comprises:

a second longitudinal slot shoulder extending substantially orthogonal from the second longitudinal slot side wall into the longitudinal slot.

28. The weight bar of claim 27 wherein the slot closure bar comprises:

a slot closure bar inner surface engaging the first and second longitudinal slot shoulders;

a first slot closure bar side wall substantially parallel to the longitudinal axis; and a second slot closure bar side wall substantially parallel to the longitudinal axis.

29. The weight bar of claim 28 wherein the slot closure bar retainer comprises: a locking pin extending from the first and second slot closure bar side walls substantially orthogonal to the longitudinal axis and engaging a locking pin groove in a weight section bottom bore.

30. The weight bar of claim 19, wherein the slot closure bar bottom end retainer comprises:

a locking pin slot in the bottom end bore face and a locking pin in the slot closure bar.

31. The weight bar of claim 30, wherein the weight section further comprises:

a bottom end bore face in the bottom end bore substantially orthogonal to the longitudinal axis.

32. The weight bar of claim 31, wherein the locking pin slot is in the bottom end bore face.

33. The weight bar of claim 19, wherein the slot closure bar fits in and substantially fills the longitudinal slot.

34. The weight bar of claim 19 wherein the slot closure bar comprises: a slot closure bar outer surface extending less than 180 degrees about the longitudinal axis from the slot closure bar top end to the slot closure bar bottom end.

* * * * *